US005995893A

United States Patent [19]

Lee et al.

[11] Patent Number: 5,995,893

[45] Date of Patent: Nov. 30, 1999

[54] DEVICE FOR CONTROLLING THE OPERATION OF POWER EXCAVATORS

[75] Inventors: Jin Han Lee; Jeong Chul Lee, both of Changwon, Rep. of Korea

[73] Assignee: Samsung Heavy Industries Co., Ltd., Kyung Nam, Rep. of Korea

[21] Appl. No.: 08/751,200

[22] Filed: Nov. 15, 1996

[30] Foreign Application Priority Data

Dec. 30, 1995 [KR] Rep. of Korea ..... 95-68501

[51] Int. Cl.[6] ..... B66F 9/00

[52] U.S. Cl. ..... 701/50; 414/680; 414/695.5; 414/695.7; 414/694

[58] Field of Search ..... 701/50; 37/348; 414/680, 686, 694, 695.5, 695.6, 695.7

[56] References Cited

U.S. PATENT DOCUMENTS

| | | | |
|---|---|---|---|
| 4,395,191 | 7/1983 | Kaiser | 414/694 |
| 4,938,091 | 7/1990 | Waggoner et al. | 74/471 XY |
| 5,442,868 | 8/1995 | Ahn | 37/348 |
| 5,493,798 | 2/1996 | Rocke et al. | 37/348 |

FOREIGN PATENT DOCUMENTS 2228783 9/1990 United Kingdom .

*Primary Examiner*—William A. Cuchlinski, Jr.
*Assistant Examiner*—Yonel Beaulieu
*Attorney, Agent, or Firm*—Kenyon & Kenyon

[57] ABSTRACT

A device for controlling the operation of power excavators includes a control lever which is handled simply by one hand, which is different from the prior art systems having multiple control levers necessarily handled by both hands. The control lever consists of a plurality of links which are jointed together in such a way that the intuitive handling directions of the links are identified with the actual moving directions of the actuators. The control lever thus adds significant convenience for the operator when operating the actuators of the excavator. An excavator with the above control device can be easily and effectively operated by an unskilled operator even for delicate work such as a land finishing work or loading work, both of which tasks are generally known in the art to require a highly-skilled operator.

5 Claims, 3 Drawing Sheets

DEVICE FOR CONTROLLING THE OPERATION OF POWER EXCAVATORS

BACKGROUND OF THE INVENTION

1. Field of the Invention

The present invention relates, in general, to a device for controlling the operation of power excavators and, more particularly, to an improvement in such a device for easily controlling both the turning motion of a turret relative to a travelling part of a power excavator and the rotating motions of the working members, such as the boom, arm and bucket of the excavator, during the operation of the excavator.

2. Description of the Prior Art

As well known to those skilled in the art, power excavators are representative construction vehicles, which are preferably used for digging. A conventional crawler-type power excavator is shown in FIG. 1. As shown in FIG. 1, the crawler-type power excavator has a travelling part 1 and a turret 2. The turret 2 is mounted rotatably to the top of the travelling part 1 with a swing unit 3 interposed between the travelling part 1 and turret 2. Due to the above swing unit 3, the turret 2 can be turned in opposite directions relative to the travelling part 1. The above swing unit 3 includes a swing motor as an actuator.

The turret 2 is equipped with a control cap 4, a drive unit and various elements associated with the drive unit. The excavator also includes a plurality of working members, that is, a boom 5, arm 6 and bucket 7 which are jointed together.

The above boom 5 is jointed to the front of the turret 2, so that the boom 5 can be rotated up and down relative to the turret 2. The above arm 6 is jointed to the tip of the boom 5, so that the arm 6 can be rotated in and out relative to the boom 5. The above bucket 7 is jointed to the tip of the arm 6, so that the bucket 7 can be rotated in and out relative to the arm 6. At the joints between the working members 5, 6 and 7, a plurality of cylinder actuators 8, 9 and 10 are provided for moving the working members 5, 6 and 7.

In order to control the operation of the boom 5, arm 6, bucket 7 and swing unit 3, two control levers 11*a* and 11*b* which are shown in FIG. 2 are typically provided in the left and right sections in front of the operator's seat inside the control cap. The left control lever 11*a* controls the operation of both the swing unit 3 and the arm 6. That is, when the left control lever 11*a* is pushed leftward or rightward, the swing unit 3 along with the turret 2 is turned in either direction relative to the travelling part 1. When the left control lever 11*a* is pushed forward or backward, the arm 6 is rotated in or out relative to the tip of the boom 5.

Meanwhile, the right control lever 11*b* controls the operation of both the boom 5 and the bucket 7. That is, when the right control lever 11*b* is pushed leftward or rightward, the bucket 7 is rotated in or out relative to the tip of the arm 6. When the right control lever 11*b* is pushed forward or backward, the boom 6 is rotated up or down relative to the turret 2.

While performing the desired work such as a land finishing or loading work, the operator of the above power excavator must individually or collectively handle the control levers 11*a* and 11*b* in order to appropriately control the rotating motions of the boom 5, arm 6 and bucket 7 and control the turning motion of the turret 2 relative to the travelling part 1.

However, the above control levers 11*a* and 11*b* are inconvenient to the operator because the operator must use both hands in order to collectively handle the levers 11*a* and 11*b*. In addition, the intuitive handling directions of the levers 11*a* and 11*b* are not identified with the actual moving directions of the associated working members 5, 6 and 7 and the swing unit 3. Therefore, it is very difficult to use the control levers 11*a* and 11*b*. That means that a power excavator must be operated by a highly-skilled operator, particularly when the excavator performs delicate work, such as a land finishing or loading work.

Japanese Patent Laid-open Publication No. Hei. 2-197627 discloses "a control lever for power excavators". In the above Japanese control lever, an additional control means 71 (see the drawings, FIGS. 1 to 8, accompanied by the cited reference) is provided on the top of a typical control lever 31 (see the drawings, FIGS. 1 to 8, accompanied by the cited reference), so that the boom, arm, bucket and swing unit of a power excavator can be operated by using the control lever that has the additional control means.

However, in the above Japanese control lever, the intuitive handling directions of the lever with the additional control means are not identified with the actual moving directions of the boom, arm, bucket and swing unit. In this regard, the intuitive handling of the lever may cause a safety accident of the power excavator during the operation of the excavator. Another problem of the above Japanese control lever resides in that the operator must be highly skilled in order to perform the operation of the lever.

SUMMARY OF THE INVENTION

It is, therefore, an object of the present invention to provide a device for controlling the operation of power excavators in which the above problems can be overcome and which includes a single control lever, the control lever being easily handled by a skilled or unskilled operator in a way such that the intuitive handling directions of the lever are directly identified with the actual moving directions of the boom, arm, bucket and swing motor while controlling both the turning motion of a turret relative to a travelling part and the rotating motions of the boom, arm and bucket during the operation of the excavator.

In order to accomplish the above object, the control device according to the invention comprises a plurality of directional control valves used for controlling flow direction of pressurized oil for actuators of the excavator in response to current control signals thereby controlling the moving directions of the actuators, and further comprises a plurality of proportional control valves adapted for controlling the spool strokes of the respective directional control valves in response to the control signals; a control lever consisting of a plurality of links jointed together, the links being selectively rotated, retracted or extended by an operator of the excavator in order to control the motions of the actuators; means for sensing angular and linear displacements of the links and outputting sensing signals indicative of the angular and linear displacements; and a controller connected to the sensing means and adapted for receiving the sensing signals from the sensing means and operating the sensing signals in accordance with a programmed process and outputting the current control signals to the proportional control valves.

In accordance with the preferred embodiment of this invention, the above control levers comprises a fixed shaft extending from a panel of the excavator's body in a first axis; a first link having a telescopic construction and jointed to an end of the fixed shaft in order to be rotatable up and down about a second axis passing a hinge shaft between the fixed shaft and the first link; a second link jointed to an end of the first link in order to be always perpendicular to the first link, the second link being rotatable about a third axis identified with a central axis of the second link; and a handle jointed to an end of the second link so that the handle is rotatable about a fourth axis, the fourth axis crossing with the third axis and being parallel to the second axis.

The above first link preferably comprises: a rotatable rod jointed to the fixed shaft in order to be rotatable up and down about the second axis; a movable rod jointed to the second link and nested in the rotatable rod so that the movable rod linearly reciprocates relative to the rotatable rod; and a slide unit adapted for guiding the linear reciprocating motion of the movable rod relative to the rotatable rod. The slide unit comprises a pinion gear provided on the rotatable rod, and a rack gear axially arranged on the movable rod and gearing into the pinion gear.

The above sensing means comprises: a first sensor provided in the joint between the fixed shaft and the first link and detecting a rotating direction and angle of the first link relative to the fixed shaft; a second sensor coupled to a pinion gear of the first link and detecting a rotating direction and angle of the pinion gear thereby checking a linear displacement of the first link; a third sensor provided in the joint between the first link and the second link and detecting a rotating direction and angle of the second link; and a fourth sensor provided in the joint between the second link and the handle and detecting a rotating direction and angle of the handle.

The above controller calculates an object moving direction and angle of the tip of the arm by operating a signal output from the first sensor and calculates an object moving velocity and angle of the tip of the boom by operating a signal from the second sensor (step 1), calculates object moving directions and velocities of the boom and arm and calculates object moving velocities of the boom and arm cylinders (step 2), calculates an object moving direction and velocity of the bucket by operating a signal output from the fourth sensor (step 3), calculates an object rotating direction and angle of the swing unit by operating a signal output from the third sensor (step 4), and outputs current control signals to the proportional control valves thus controlling the spool strokes of the directional control valves in proportion to currents of the control signals and controlling the motions of the boom, arm, bucket and swing unit (step 5).

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 3:
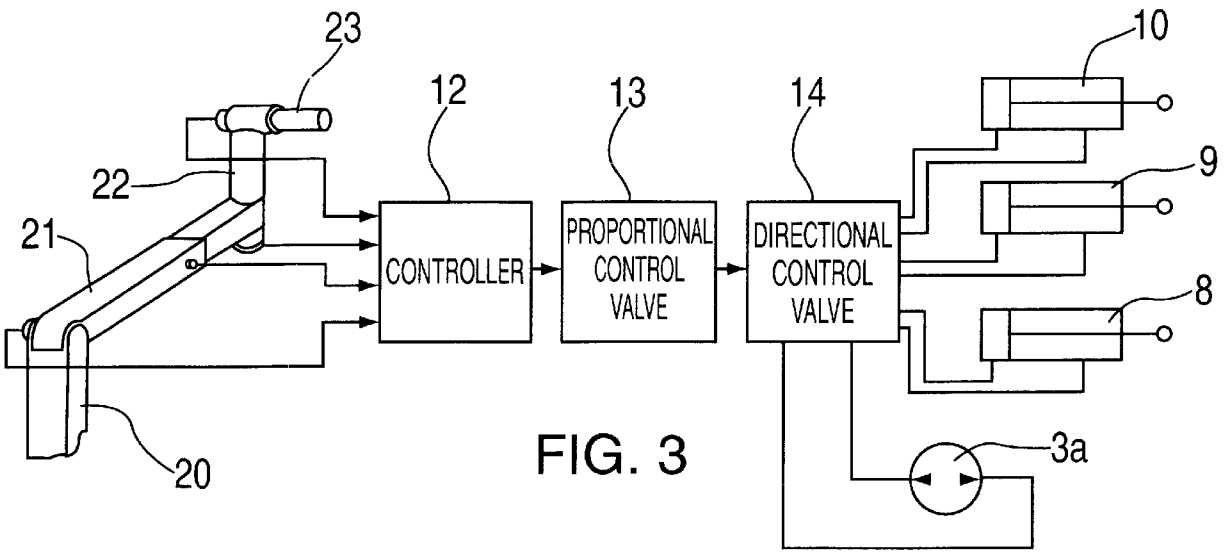
FIG. 3 is a block diagram showing the construction of a control device in accordance with the primary embodiment of the present invention.

FIG. 3 is a block diagram showing the construction of a control device for power excavators in accordance with the primary embodiment of the present invention.

Figure 1:
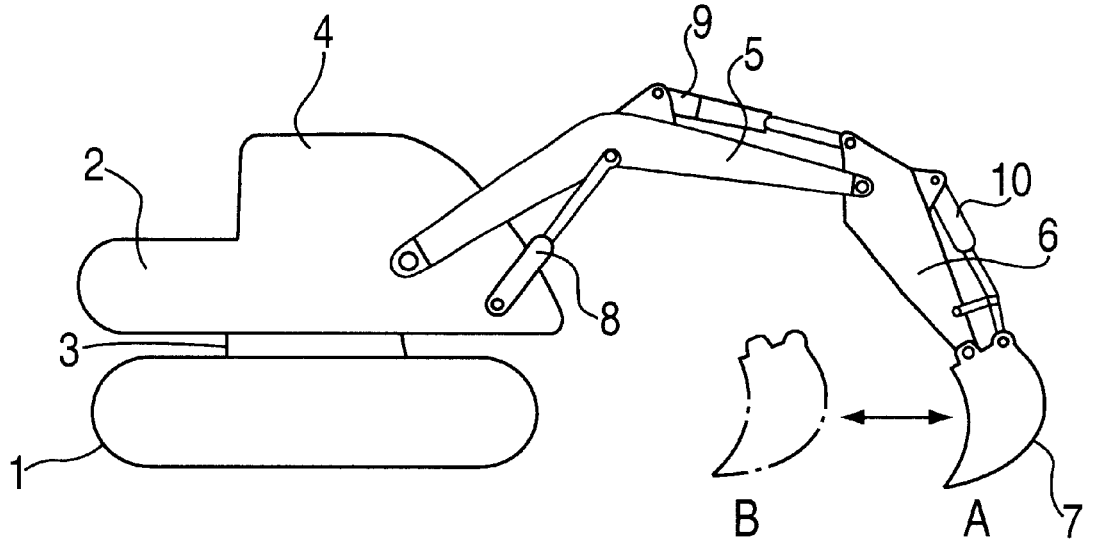
FIG. 1 PRIOR ART
FIG. 1 is a view showing the construction of a conventional crawler-type power excavator.
Figure 2:
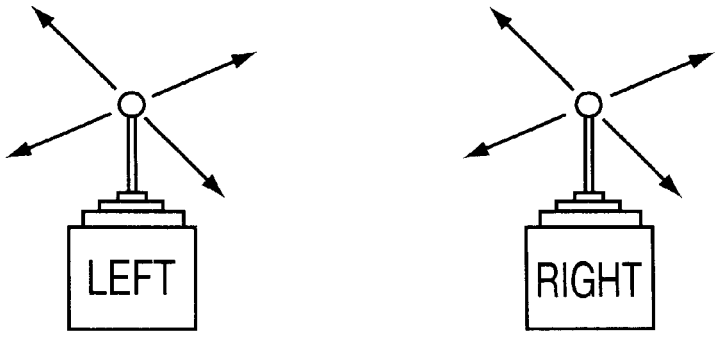
FIG. 2 PRIOR ART
FIG. 2 is a view showing typical control levers installed in the power excavator of FIG. 1.

The control device of this invention is preferably used with a power excavator, which is shown in FIG. 1. As described in the prior art, the power excavator has a travelling part 1 and a turret 2. The turret 2 is rotatably mounted to the top of the travelling part 1 by a swing unit 3 so that the turret 2 can be turned in opposite directions relative to the travelling part 1. The above swing unit 3 includes a swing motor 3*a*. The excavator also includes a plurality of working members, that is, a boom 5, arm 6 and bucket 7 which are jointed together. The above boom 5 is jointed to the front of the turret 2, so that the boom 5 can be rotated up and down relative to the turret 2. The above arm 6 is jointed to the tip of the boom 5, so that the arm 6 can be rotated in and out relative to the boom 5. The above bucket 7 is jointed to the tip of the arm 6, so that the bucket 7 can be rotated in and out relative to the arm 6.

Figure 4:
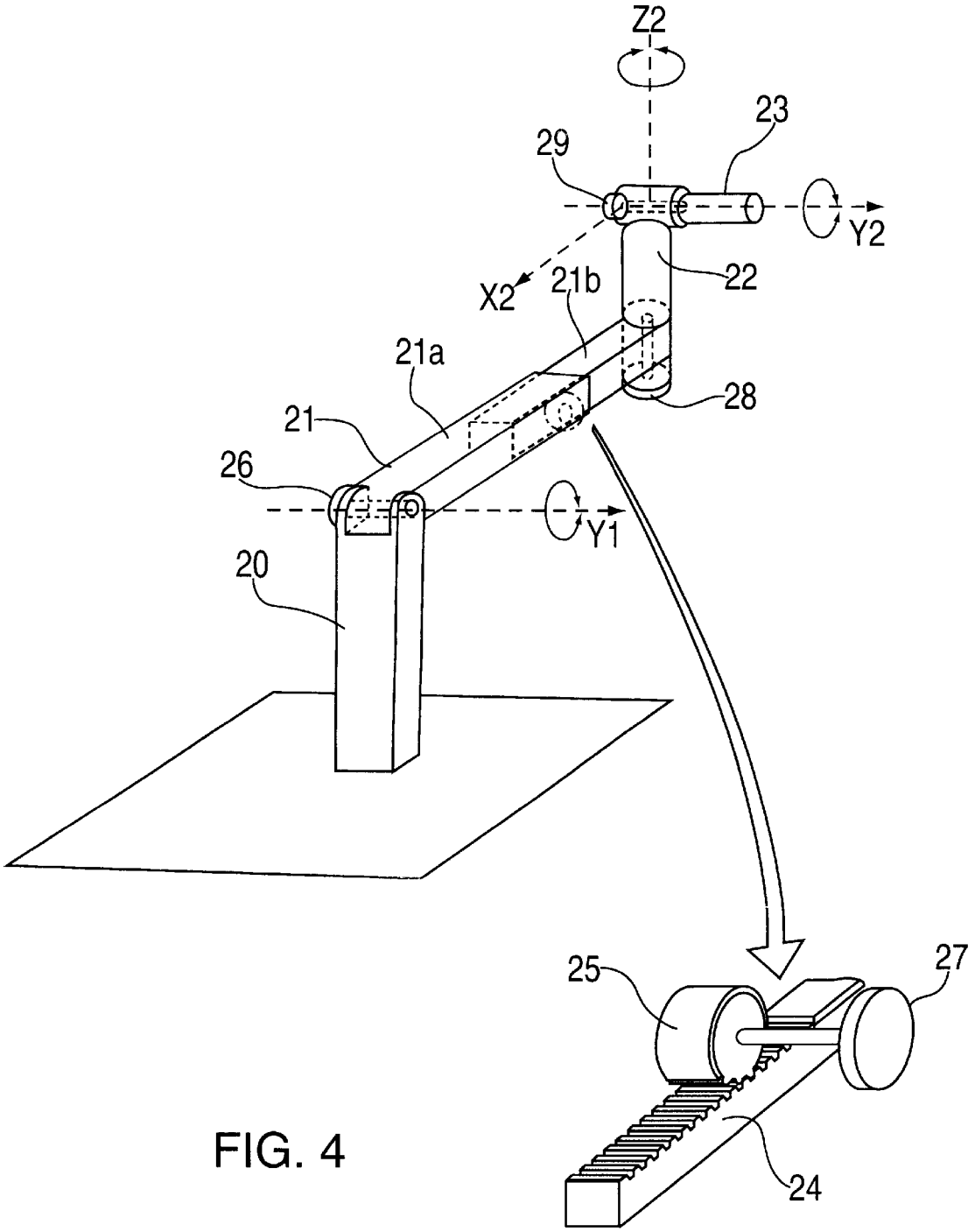
FIG. 4 is a perspective view showing the construction of a control lever included in the control device of FIG. 3.

The above control device Includes a single control lever 19. FIG. 4 shows the construction of the control lever 19 according to the primary embodiment of this invention. As shown in FIG. 4, the control lever 19 includes a fixed shaft 20, which vertically extends upward from a bottom panel inside the control cap. A first link 21 is jointed to the top of the fixed shaft 20, so that the first link 21 can be rotated up and down about the axis Y1, which passes the hinge shaft of the joint between the shaft 20 and link 21. The above first link 21 comprises two sections, one nested in the other, so that the link 21 has a telescopic construction. A second link 22 is jointed to the tip of the nested section of the first link 21, so that the second link 22 is always perpendicular to the first link 21. The above second link 22 can be rotated about the axis Z2, which is identified with the central axis of the second link 22. The tip of the second link 22 is provided with a transverse sleeve. A handle 23 is movably fitted in the transverse sleeve of the second link 22, so that the handle 23 does not linearly move, but can be rotated about the axis Y2, which crosses with the axis Z2 and is parallel to the axis Y1.

As described above, the first link 21 comprises two sections, that is, a rotatable rod 21*a* and a movable rod 21*b*. The above rotatable rod 21*a* is hinged to the top of the fixed shaft 20 thus being rotated up and down about the hinge shaft. The movable rod 21*b*, which is coupled to the second link 22, is nested in the rotatable rod 21*a*, so that the movable rod 21*b* linearly moves in opposite directions parallel to the axis X2. The first link 21 also includes a slide unit, which guides the linear reciprocating motion of the movable rod 21*b* relative to the rotatable rod 21*a*. In accordance with the primary embodiment of this invention, the slide unit preferably comprises a pinion gear 25 provided on the rotatable rod 21*a*. The above pinion gear 25 gears into a rack gear 24, which is axially arranged on the bottom of the movable rod 21*b*.

Figure 5B:
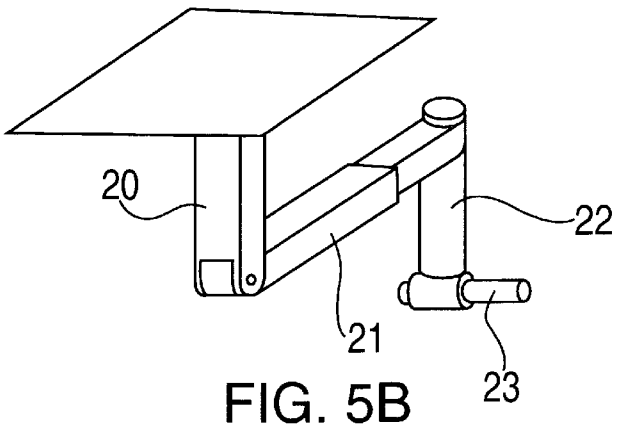
FIGS. 5A and 5B are perspective views showing the construction of control levers in accordance with other embodiments of the present invention, respectively.
Figure 5A:
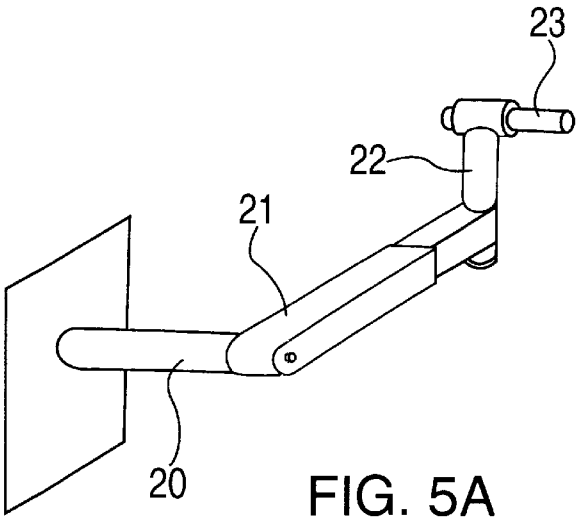

FIGS. 5A and 5B show the construction of control levers in accordance with other embodiments of the present invention, respectively. In the embodiment of FIG. 5A, the general shape of the control lever 19 remains the same as in the primary embodiment, but the fixed shaft 20 horizontally extends from a side panel inside the control cap. In the embodiment of FIG. 5B, the fixed shaft 20 vertically extends downward from an upper panel inside the control cap, and the handle sleeve of the second link 22, which receives the handle 23, is provided on the lower end of the second link 22 differently from the primary embodiment.

The above control lever also includes a plurality of sensors, that is, first to fourth sensors 26 to 29. As shown in FIG. 4, the first sensor 26 comprises a rotatable potentiometer, which is provided in the joint between the fixed shaft 20 and the first link 21 and detects the rotating direction and angle of the first link 21 relative to the fixed shaft 20. The second sensor 27 is coupled to the pinion gear 25 of the first link 21 and detects the rotating direction and angle of the pinion gear 25 during a movement of the movable rod 21*b* inside the rotatable rod 21*a* thereby checking a linear displacement of the movable rod 21*b*. The third sensor 28 is provided in the lower portion of the joint between the first link 21 and the second link 22 and detects the rotating direction and angle of the second link 22. Meanwhile, the fourth sensor 29 is provided in the joint between the second link 22 and the handle 23 and detects the rotating direction and angle of the handle 23.

As shown in FIG. 3, the control device of this invention also includes a controller 12, a plurality of proportional control valves 13 and a plurality of directional control valves 14. The directional control valves 14 control the flow direction of the pressurized oil supplied to the actuators 3*a*, 8, 9 and 10 thus controlling the actuators. The controller 12 is connected to the above sensors 26 to 29 and calculates the input data from the sensors 26 to 29 with a programmed process and outputs current control signals for the actuators to the proportional control valves 13. Upon receiving the current control signals from the controller 12, the proportional control valves 13 control the spool strokes of associated directional control valves 14 in proportion to the currents of the control signals thereby causing the directional control valves 14 to control the flow direction of the pressurized oil for the actuators.

In the process for controlling the operation of the actuators according to this invention, at step 1 the controller 12 receives signals from the first and second sensors 26 and 27, the signals being indicative of the rotating angle of the first link 21 relative to the fixed shaft 20 and the displacement of the movable rod 21*b* of the first link 21 relative to the rotatable rod 21*a*, respectively. Upon receiving the above signals, the controller 12 calculates the object moving direction and angle of the tip of the arm 6 in response to the signal from the first sensor 26. The controller 12 also calculates the object moving velocity and angle of the tip of the boom 5 in response to the signal from the second sensor 27. At step 2, the controller 12 calculates the object moving directions and velocities of the boom 5 and arm 6 prior to calculating the object moving velocities of the boom and arm cylinders 8 and 9. Thereafter, at step 3 the controller 12 receives a signal from the fourth sensor 29, the signal being indicative of the rotating direction and angle of the handle 23. The controller 12 calculates the object moving direction and velocity of the bucket 7 in accordance with the rotating direction and angle of the handle 23. At step 4, the controller 12 receives a signal from the third sensor 28, the signal being indicative of the rotating direction and angle of the second link 22. Upon receiving the signal from the third sensor 28, the controller 12 calculates the object rotating direction and angle of the swing unit 3 by operating the rotating direction and angle of the handle 23. At step 5, the controller 12 outputs control signals to the proportional control valves 13 in accordance with the calculation results of steps 1 to 4. In response to the control signals, the proportional control valves 13 control the spool strokes of associated directional control valves 14 in proportion to the currents of the control signals thereby causing the directional control valves 14 to control the flow direction of the pressurized oil for the actuators 8, 9, 10 and 3*a*. Therefore, the boom 5, arm 6, bucket 7 and swing unit 3 are operated by the respective actuators 8, 9, 10 and 3*a*.

The operational effect of the above control device will be described hereinbelow.

In order to move the bucket 7 from the initial position A to the object position B of FIG. 1, an operator handles the control lever 19 with the handle 23 gripped by a hand. The angular and linear displacements of the first link 21 in the above state are detected by the first and second sensors 26 and 27, respectively. Thereafter, the sensors 26 and 27 output signals indicative of the angular and linear displacements of the first link 21 to the controller 12. Upon receiving the signals from the first and second sensors 26 and 27, at step 1 the controller 12 calculates the object moving direction and angle of the tip of the arm 6 by operating the data from the first sensor 26. The controller 12 also calculates the moving velocity and angle of the boom 5 by operating data from the second sensor 27. Thereafter, the controller 12 calculates the object moving directions and velocities of the boom 5 and arm 6. In addition, the controller 12 calculates the object moving velocities of the boom and arm cylinders 8 and 9. Thereafter, at step 5 the controller 12 outputs control signals to the proportional control valves 13 associated with the boom and arm cylinders 8 and 9, thus controlling the spool strokes of the direction control valves 14 associated with the boom and arm cylinders 8 and 9.

The boom and arm cylinders 8 and 9 are thus operated under the control of the controller 12 thereby moving the boom 5 and arm 6 to the object positions. In accordance with the preferred embodiments of this invention, the operation of the boom 5 and arm 6 is controlled by handling the first link 21. However, when the excavator is free from the arm, the moving velocity and direction of the boom 5 are directly controlled by handling the first link 21.

Thereafter, the bucket 7 is operated. In order to move the bucket 7 to an object position, the handle 23 is rotated about the axis Y2. The rotating direction and angle of the handle 23 in the above state are detected by the fourth sensor 29, and the sensor 23 outputs a signal indicative of the rotating direction and angle of the handle 23 to the controller 12. Upon receiving the signal from the fourth sensor 29, the controller 12 calculates the object moving direction and velocity of the bucket 7 by operating the data of the rotating direction and angle of the handle 23. Thereafter, the controller 12 calculates the moving velocity of the bucket cylinder 10 prior to processing the step 5. At step 5, the controller 12 controls the proportional control valve 13 of the bucket 7 thereby controlling the spool stroke of the directional control valve 14 associated with the bucket cylinder 10. The bucket cylinder 10 is thus operated under the control of the controller 12 in order to move the bucket 7 to the desired position.

In order to rotate the swing unit 3, the second link 22 is rotated in a direction about the axis Z2. The rotating direction and angle of the second link 22 in the above state are detected by the third sensor 28. The third sensor 28 outputs a signal indicative of the rotating direction and angle of the second link 22 to the controller 12. Upon receiving the signal from the third sensor 28, at step 4 the controller 12 calculates the object moving direction and velocity of the swing unit 3 and calculates the object moving velocity of the swing motor 3*a* by operating the data from the third sensor 28 prior to processing the step 5. At step 5, the controller 12 controls the proportional control valve 13 associated with the swing unit 3 thereby controlling the spool stroke of the directional control valve 14 associated with the swing motor 3*a*. The swing motor 3*a* is thus operated under the control of the controller 12 so that the swing unit 3 along with the turret 2 is rotated in the object direction relative to the travelling part 1 of the excavator.

As described above, the present invention provides a device for controlling the operation of power excavators. In accordance with the control device of this invention, the operation of the actuators such as a bucket, boom, arm and swing motor of an excavator is easily controlled by appropriately handling a single control lever. The control lever of this invention is simply handled by one hand differently from the typical control levers necessarily handled by both hands. The control lever of this invention allows the hand, that is free from handling the control lever, to be spared for other objectives and is more convenient to the operators. The above control lever comprises a plurality of links, which are jointed together in a way such that the intuitive handling directions of the links are identified with the actual moving directions of the actuators. The control lever is thus convenient to the operators, while operating the actuators of the excavator. Therefore, the power excavator with the above control device can be easily and effectively operated by an unskilled operator even when the power excavator performs delicate work such as a land finishing or loading work which is noted to be necessarily operated by a highly-skilled operator.

What is claimed is:

1. A device for controlling the operation of a power excavator, comprising a plurality of directional control valves used for controlling flow direction of pressurized oil for actuators of the excavator in response to current control signals thereby controlling the moving directions of the actuators, further comprising:

a plurality of proportional control valves controlling spook strokes of the respective directional control valves in response to said control signals;

a control lever comprising a plurality of links jointed together, said links being selectively rotated, retracted or extended by an operator of said excavator in order to control the motions of said actuators, at least two of said links being jointed by a linear joint;

means for sensing angular and linear displacements of said links and outputting sensing signals indicative of the angular and linear displacements; and a controller connected to said sensing means for receiving said sensing signals from the sensing means and operating the sensing signals in accordance with a programmed process and outputting the current control signal to said proportional control valves.

2. The control device according to claim 1, wherein said control lever comprises:

a fixed shaft extending from a panel of the excavator's body in a first axis;

a first link having a telescopic construction and jointed to an end of said fixed shaft in order to be rotatable up and down about a second axis passing a hinge shaft between the fixed shaft and the first link;

a second link jointed to an end of said first link in order to be always perpendicular to said first link, said second link being rotatable about a third axis identified with a central axis of the second link; and a handle jointed to an end of said second link so that the handle is rotatable about a fourth axis, said fourth axis crossing with the third axis and being parallel to the second axis.

3. The control device according to claim 2, wherein said first link comprises:

a rotatable rod jointed to said fixed shaft in order to be rotatable up and down about said second axis;

a movable rod jointed to said second link and nested in said rotatable rod so that the movable rod linearly reciprocates relative to said rotatable rod; and a slide unit for guiding the linear reciprocating motion of the movable rod relative to the rotatable rod, said slide unit comprising:

a pinion gear provided on the rotatable rod; and a rack gear axially arranged on the movable rod and gearing into said pinion gear.

4. The control device according to claim 2, wherein said sensing means comprises:

a first sensor provided in the joint between the fixed shaft and the first link and detecting a rotating direction and angle of the first link relative to the fixed shaft;

a second sensor coupled to a pinion gear of said first link and detecting a rotating direction and angle of said pinion gear thereby checking a linear displacement of said first link;

a third sensor provided in the joint between the first link and the second link and detecting a rotating direction and angle of the second link; and a fourth sensor provided in the joint between the second link and the handle and detecting a rotating direction and angle of the handle.

5. The control device according to claim 4, wherein said controller calculates an object moving direction and angle of the tip of an arm by operating a signal output from the first sensor, and calculates an object moving velocity and angle of the tip of a boom by operating a signal from the second sensor;

calculates object moving directions and velocities of the boom and arm and calculates object moving velocities of boom and arm cylinders;

calculates an object moving direction and velocity of a bucket by operating a signal output from the fourth sensor;

calculates an object rotating direction and angle of a swing unit by operating a signal output from the third sensor; and outputs current control signals to the proportional control valves thus controlling the spool strokes of the directional control valves in proportion to currents of the control signals and controlling the motions of the boom, arm, bucket and swing unit.

* * * * *